US007594368B2

(12) United States Patent
Kurz

(10) Patent No.: US 7,594,368 B2
(45) Date of Patent: Sep. 29, 2009

(54) DEVICE FOR FASTENING TERMINATION STRIPS

(75) Inventor: Sebastian Kurz, Eyrs (IT)

(73) Assignee: Karl Pedross AG, Latsch (IT)

( * ) Notice: Subject to any disclaimer, the term of this patent is extended or adjusted under 35 U.S.C. 154(b) by 247 days.

(21) Appl. No.: 11/665,464

(22) PCT Filed: Apr. 4, 2006

(86) PCT No.: PCT/EP2006/003109

§ 371 (c)(1),
(2), (4) Date: Apr. 16, 2007

(87) PCT Pub. No.: WO2006/105956

PCT Pub. Date: Oct. 12, 2006

(65) Prior Publication Data

US 2009/0044469 A1 Feb. 19, 2009

(30) Foreign Application Priority Data

Apr. 5, 2005 (DE) ..... 20 2005 005 425

(51) Int. Cl.
*E04F 19/04* (2006.01)

(52) U.S. Cl. ..... 52/290; 52/288.1; 52/718.03; 52/506.05; 24/289; 24/297

(58) Field of Classification Search ..... 52/288.1, 52/287.1, 716.1, 718.01, 718.04, 710.06, 52/718.03, 510, 506.06, 290, 506.05, 718.06; 24/289, 292, 293, 295, 297, 291
See application file for complete search history.

(56) References Cited

U.S. PATENT DOCUMENTS 740,046 A * 9/1903 Salstrom ..... 52/716.1
1,483,941 A * 2/1924 Kasson ..... 52/273
1,981,239 A * 11/1934 Manske ..... 52/220.7

(Continued)

FOREIGN PATENT DOCUMENTS

DE 41 12 798 A1 10/1992

(Continued)

OTHER PUBLICATIONS

International Search Report.

*Primary Examiner*—Brian E Glessner
(74) *Attorney, Agent, or Firm*—Collard & Roe, P.C.

(57) ABSTRACT

The invention relates to a device for fastening termination strips, in particular skirting, wall termination strips or the like, comprising an angle profile which bears against the wall and/or floor and which has a fastening part in the form of a receiving finger onto which the termination strip can be fitted and held with a clamping fit, it is intended to simplify manufacture, make adaptation to variable floors possible and allow retrofitting by proposing that the receiving finger is a web which is notched out of the floor leg of the angle profile situated on the floor and which is formed upwards in a curve, this web extending in a straight and at an acute angle towards the wall leg of the angle profile and engaging in a longitudinal groove made in the bottom of the termination strip, in which groove the curve of the web presses against the outwardly directed lower wall of the longitudinal groove and the upper endpiece of the receiving finger presses against the inwardly directed wall of the longitudinal groove.

8 Claims, 3 Drawing Sheets

U.S. PATENT DOCUMENTS

| | | | | | |
|---|---|---|---|---|---|
| 2,166,889 | A | * | 7/1939 | Churchill | 52/718.04 |
| 2,178,501 | A | * | 10/1939 | Staneampiano et al. | 52/288.1 |
| 2,184,249 | A | * | 12/1939 | Churchill | 52/718.04 |
| 2,506,030 | A | * | 5/1950 | Mapes | 16/7 |
| 2,823,071 | A | * | 2/1958 | Malpass | 49/440 |
| 3,004,643 | A | * | 10/1961 | MacCallum | 52/718.04 |
| 3,006,444 | A | * | 10/1961 | MacCallum | 52/718.04 |
| 3,228,160 | A | * | 1/1966 | O'Brien | 52/242 |
| 3,298,147 | A | * | 1/1967 | Haberman | 52/288.1 |
| 3,449,873 | A | * | 6/1969 | Zittler et al. | 52/127.12 |
| 3,464,177 | A | * | 9/1969 | Amato | 52/288.1 |
| 3,707,061 | A | * | 12/1972 | Collette et al. | 52/288.1 |
| 4,337,604 | A | * | 7/1982 | Burgers | 52/288.1 |
| 5,152,117 | A | * | 10/1992 | Wynar | 52/712 |
| 5,243,800 | A | * | 9/1993 | Olbrich | 52/287.1 |
| 5,359,817 | A | * | 11/1994 | Fulton | 52/288.1 |
| 5,376,423 | A | * | 12/1994 | Wiegand | 428/99 |
| 5,526,553 | A | * | 6/1996 | Klein | 24/295 |
| 5,694,726 | A | * | 12/1997 | Wu | 52/287.1 |
| 5,960,600 | A | * | 10/1999 | Monaco | 52/287.1 |
| 6,115,982 | A | | 9/2000 | Lindenberg | |
| 6,186,605 | B1 | * | 2/2001 | Nelson | 312/140.4 |
| 6,315,489 | B1 | * | 11/2001 | Watanabe | 403/381 |
| 6,381,915 | B1 | * | 5/2002 | Wood | 52/718.06 |
| 6,499,198 | B2 | * | 12/2002 | Eckenrode | 24/295 |
| 6,505,448 | B2 | * | 1/2003 | Ito | 52/474 |
| 6,550,192 | B1 | * | 4/2003 | Nelson et al. | 52/177 |
| 6,560,944 | B1 | * | 5/2003 | Wilson | 52/717.01 |
| 6,643,987 | B2 | * | 11/2003 | Rusch et al. | 52/506.05 |
| 6,729,087 | B2 | * | 5/2004 | Sauter | 52/290 |
| 6,786,016 | B1 | * | 9/2004 | Wood | 52/290 |
| 6,830,405 | B2 | * | 12/2004 | Watanabe | 403/14 |
| 6,843,032 | B2 | * | 1/2005 | Hikai | 52/287.1 |
| 2004/0168384 | A1 | * | 9/2004 | Wesolowska | 52/287.1 |

FOREIGN PATENT DOCUMENTS

| | | | | |
|---|---|---|---|---|
| DE | 198 60 319 | A1 | | 7/2000 |
| DE | 102 20 049 | A1 | | 11/2003 |
| EP | 560748 | A1 | * | 9/1993 |
| EP | 608208 | A1 | * | 7/1994 |
| EP | 0 900 897 | A | | 3/1999 |
| EP | 1 347 119 | A | | 9/2003 |
| EP | 1 536 083 | A | | 6/2005 |

* cited by examiner

DEVICE FOR FASTENING TERMINATION STRIPS

CROSS REFERENCE TO RELATED APPLICATIONS

Application claimes priority under 35 U.S.C. §119 of German Application No. 20 2005 005 425.9 filed Apr. 5, 2005. Applicant also claimes priority under 35 U.S.C. §365 of PCT/EP2006/003109 filed Apr. 4, 2006. The international application under PCT article 21(2) was not published in English.

The invention relates to a device for fastening termination strips.

When floors such as screed flooring or also floor coverings such as carpeting or parquet flooring are being laid, a gap inevitably remains at the wall, and this can increase further over time as a result of the floor settling. A wide variety of different termination strips have been developed in order to cover and close off this unsightly gap. EP 900897 A2 discloses a device for fastening skirting boards in which an installation rail is designed with a receiving space which is assigned to a floor-covering edge region and engages around the floor-covering edge region in a form-fitting manner. For this purpose, the installation rail has an approximately U-shaped cross section in this region. The U-leg resting on a top side of the floor covering is designed as a double leg in which it is possible to plug an intermediate rail with a latching profile. This intermediate rail is of L-shaped design and likewise has a latching profile, which can be latched to a skirting board. Such a construction with an intermediate rail involves comparatively high outlay and cannot be installed with precision. Furthermore, DE 102 20 049 A1 discloses a device for fastening termination strips in which an angle profile has, as installation rail, a crosspiece which rises upward from the floor leg, onto which the termination strip is plugged and which presses the termination strip against the wall exclusively by way of its crosspiece end, with predetermined spring stressing. The contact pressure is determined only by the oblique positioning, the length and the material of the crosspiece. Modification is not possible. The system and the construction involve very high outlay, are very rigid and do not allow for any correction work.

The object of the invention is to provide a device for fastening skirting boards which can be produced with low outlay, and is thus straightforward and inexpensive, which can be easily adapted, even in the case of floors which may alter, and which, finally, can also be retrofitted.

This object is achieved according to the invention by a construction set comprising a termination strip; and a device for fastening the termination strip. The device comprises an installation profile for the termination strip formed by an angle profile which butts against a wall or floor and, as a fastening part, has a receiving finger on which the termination strip, which can be plugged thereon, is retained with a clamping fit, with the angle profile having a wall leg and a floor leg. The receiving finger is a crosspiece which is disengaged from the floor leg of the angle profile and is bent upward via a curve and approaches the wall leg of the angle profile rectilinearly and at an acute angle ($\alpha$) and engages in a longitudinal groove in the termination strip from beneath. The curve of the crosspiece presses against an outwardly directed bottom wall of the longitudinal groove and a top end piece of the receiving finger presses against an inwardly directed wall of the longitudinal groove. There is no need for any great outlay in order to cut out part of the floor leg as a strip and bend this upward into a curve to give an upright crosspiece which serves as a receiving finger for a plug-on termination strip. For this purpose, the termination strip has a longitudinal groove on its base surface. The crosspiece, which is curved in the foot region and is otherwise rectilinear, but approaches the wall leg of the angle profile at an acute angle, has the correct level of prestressing in order, by way of its top end region, to press the attached termination strip against the wall. The termination strip attached to the receiving finger grips over the receiving finger by way of the longitudinal groove, and one of its walls presses, in the bottom region, against the curve, attempting to make it narrower, and thus increases the spring force in the crosspiece which pushes to the side, so that the termination strip is pressed against the wall to a more pronounced extent in the top region and is forced away from the same in the bottom region. This device is particularly straightforward and inexpensive since the receiving finger is merely a disengaged constituent part of the floor leg of the angle profile.

The easiest way of forming the receiving finger in the angle profile is to cut the receiving finger perpendicularly to the angle corner. The angle profile may be a short component in which two cuts are made as far as the angle corner to form two strips, which remain on either side of a central strip. Either the two outer strips can be bent up via a curve and the central strip remains as the floor leg or the central strip is bent upward via a curve and the two remaining outer strips form the supporting and/or securable floor leg. The outlay required for producing such a device is low.

In order to secure the termination strip on the installation profile, the base of the termination strip contains a groove by means of which this strip can be plugged onto the receiving finger. In order that the receiving finger in the groove presses sufficiently against the inner side wall and presses the termination strip sufficiently against the wall, it is particularly advantageous if the curve of the crosspiece covers more than 90° and the acute angle of the crosspiece in relation to the wall leg is preferably between 5° and 30°. By virtue of covering more than 90°, the curve has good surface support against the wall in the bottom region of the groove. As a result of the curve covering more than 90°, the receiving finger then runs diagonally in the groove, so that the free end thereof presses against the opposite inner wall of the groove and thus presses the termination strip against the wall. In particular, the curve has an effect on the increased spring force, so that an acute angle as small as 5° may be sufficient as an approach angle in relation to the wall leg, if the groove is of sufficiently narrow design. Even an angle of 30° will have only a positive effect on the contact-pressure force because, as a result of the formation of the curve and the free abutment against the inner wall of the groove, the receiving finger will correspondingly straighten out and align itself.

In order that the termination strip can easily be plugged onto the receiving finger, it is advantageous if the free end of the receiving finger is bent or rounded in a direction counter to the curve. The bent or rounded end of the receiving finger means that, when the termination strip is plugged on, the receiving finger slides easily, without resistance, into the groove provided. This does away with any laborious insertion work or even the need to cut into the base region of the termination strip. This advantage is important, in particular, because things are very rough and ready in the building trade and the parts, unless they just slide into the correct position, often have to be moved into position using a striking tool. Also, for adjusting the termination strip into the correct position, it is advantageous if the free end of the receiving finger has a rounded surface, rather than a sharp edge, for pressing against the inner wall of the groove on which it is to slide. Little outlay is required to bend or round the free end of the receiving finger in the direction counter to the curve, and the advantages outlined above are very easily achieved as a result.

Depending on the length of the angle component, whether a number of meters or only a few centimeters, the corresponding number of cuts in the floor leg can also produce a number of receiving fingers, which are then disengaged from the floor leg. The short angle component with one or two receiving fingers will be utilized for walls with lots of corners. The long angle-component configuration with a number of receiving fingers distributed over the length will be utilized for long, rectilinear walls for which the covering strip nevertheless has to be retained at a relatively large number of points over its length. It is very advantageous that, for this straightforward production, the respective floor coverings and wall configurations can be treated on a very individual basis. It is also very advantageous for it to be possible for the receiving fingers to be disengaged from the floor leg at a distance from one another by straightforward cuts.

Since the termination strip, rather than having to absorb any load-bearing forces, is a lightweight decorative strip which merely needs to cover an unsightly joint, it is sufficient if the receiving finger is a thin, resilient strip made of metal or plastic which engages in the longitudinal groove in the termination strip, the groove being at least three times as thick as the receiving finger. The thin, resilient metal strip is obtained from the floor leg of the angle profile if the latter is produced from metal. All that is required is for a cut to be made in the floor leg as far as the angle corner and for the resulting metal strip to be bent upward via a curve. In order to provide the metal strip with the desired spring force, the part is, of course, subjected to a hardening process, although this is carried out very quickly and straightforwardly. If the angle component is to consist of plastic, it is produced by injection molding in a mold in which the receiving finger has already been shaped as desired with a curve and an acute angle in relation to the wall leg. There are a sufficient number of plastics which impart the necessary level of elasticity and spring force to the receiving finger. In order for the termination strip to be attached easily and straightforwardly to the receiving finger of the installation profile, it has proven advantageous for the groove to be at least three times the width of the receiving finger engaging therein, in order that the crosspiece, which is acute-angled but bent at its free end, slides into the groove without resistance and positions itself laterally against the groove wall. As soon as the curved part of the finger enters into the groove, the top part of the finger is pressed toward the opposite side and thus onto the wall.

It has been found to be very advantageous if the height of the receiving finger is shorter than the depth of the longitudinal groove in the termination strip. It is imperative for the depth of the groove in the termination strip to be greater than the height of the receiving finger, in order that the termination strip always has its lowermost peripheral edge positioned on the floor and covers the unsightly gap. Even if the floor should settle over time, it would be necessary for the termination strip to be repositioned on the floor covering by way of its bottom edge by being pushed down again. The fact that the depth of the groove in the termination strip is greater than the height of the receiving finger means that the top edge of the receiving finger will never strike against the inner end of the groove.

Finally, it is advantageous for installation purposes if the device is provided with a downwardly angled tongue projecting out of the floor leg of the angle profile. Thus, a tongue which projects downward from the floor leg immediately indicates if the installation profile has not been arranged properly on the wall directly above the gap. The tongue has to engage in the gap if the installation profile is both seated on the floor covering and butts against the wall. There is no need for any great outlay to cut or punch a tongue at least out of the floor leg such that it can be bent downward. It would also be possible to make the punch cut in the wall leg, in order for it to be possible for the tongue to be bent out more easily. The decisive factor is for the tongue to project downward out of the floor leg and to be able to engage in the gap in the floor between the floor covering and wall.

The invention is described in more detail hereinbelow, by way of example, with reference to the drawings, in which.

Figure 1:
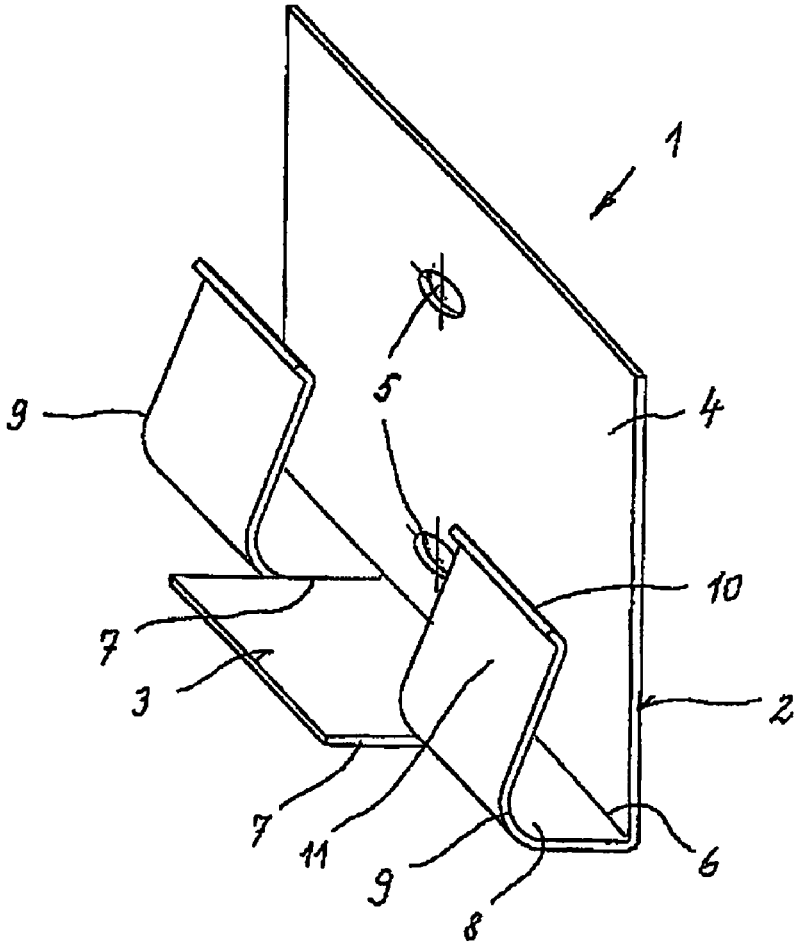
FIG. 1 shows a perspective view of a device.

The device 1 illustrated in FIG. 1 is an installation profile for securing termination strips. The device 1 comprises an angle profile 2 which has a floor leg 3 and a wall leg 4. As can be gathered from FIG. 1, the wall leg 4 is provided with two holes 5 which are intended for the fastening screws (not illustrated). The angle profile 2 is secured on the wall, directly above the floor covering. It would likewise be possible to secure the angle profile 2 on the floor via the floor leg 3. In this case, a screw fastening is usually preferred, although adhesive bonding would also be possible. The floor leg 3 has an incision 7 which approaches the angle corner 6 of the angle profile 2 to form a crosspiece 8 which is bent upward via a curve 9. The curve 9 covers somewhat more than 90°, so that the crosspiece 8 is directed toward the wall leg 4 at an acute angle $\alpha$ of approximately 5° to 30°. At the top, free end 10, the crosspiece 8 is bent counter to the direction of the curve 9. This end 10 could also be rolled in. This crosspiece 8, which has been bent up and thus disengaged from the floor leg 3, forms a receiving finger 11 for a termination strip 12, which can be plugged on and can only be seen in FIG. 5.

The floor leg 3 also has a further incision 7, which forms a second receiving finger 11 with the curve 9 and the bent end 10. It would also be possible, however, for the two outer crosspieces 8 to be left as floor legs and for the central floor leg to be bent up as a crosspiece 8 and thus formed into the receiving finger 11.

Figure 2:
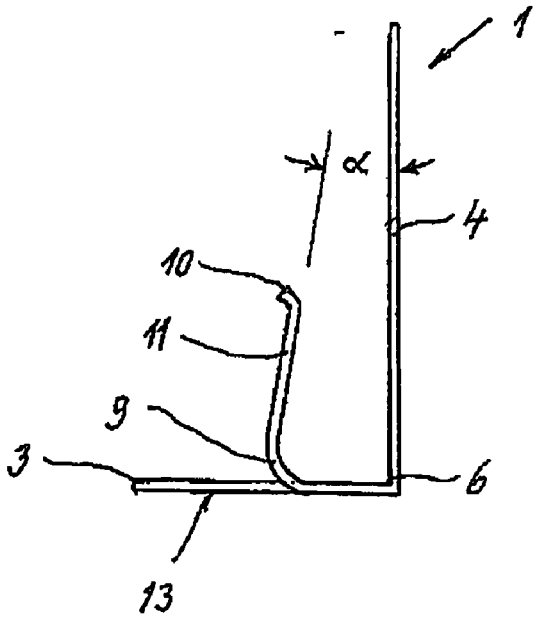
FIG. 2 shows a side view of the same device.

FIG. 2 shows the device 1 from the side. The individual parts are provided with the same designations. It can also be seen clearly in this figure how the crosspiece 8 is bent upward via the curve 9 to form the receiving finger 11, the curve 9 in the process covering somewhat more than 90°, so that the receiving finger 11 is directed toward the wall leg 4 at an angle $\alpha$ of approximately 10°. Its free end 10 is bent toward the opposite side. The floor leg 3 remains resting on the floor covering 21 and could be coated with an adhesive on its underside 13.

Figure 3:
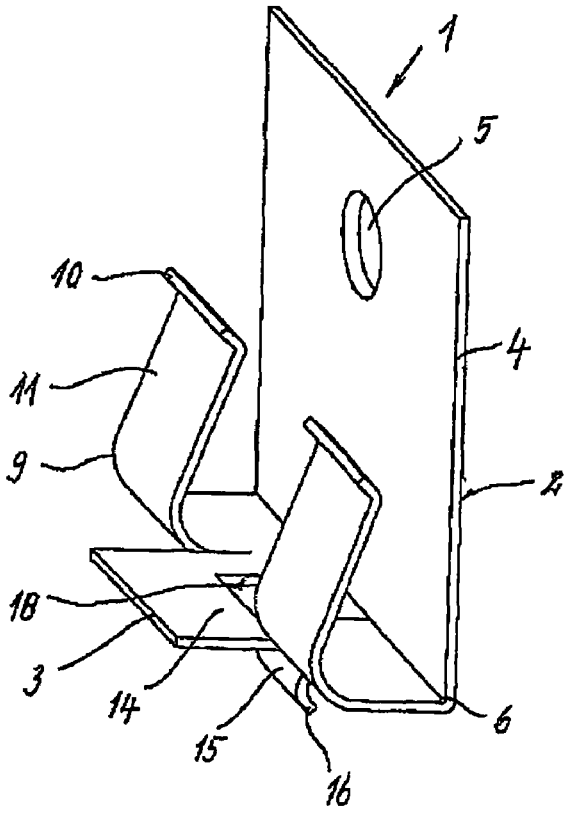
FIG. 3 shows a perspective view of a modified device.

FIG. 3 illustrates the device 1 in the same way as FIG. 1, and all the same parts have the same designations. The only difference in FIG. 3, in relation to FIG. 1, is the tongue 15, which has been punched out of the central part 14 of the floor leg 3 and bent downward and of which only the free, bent end 16 is visible. Also visible is the punched-out hole 17 which results from the tongue 15 being bent out. The tongue cut 18 in FIG. 3 extends up to the angle corner 6, the tongue 15 itself assuming an angle $\beta$ of approximately 5° to 30° in relation to the wall leg 4 in order to engage in the gap 19, also with prestressing, between the wall 20 and the floor covering 21 and to press the angle profile 2 onto the wall.

Figure 4:
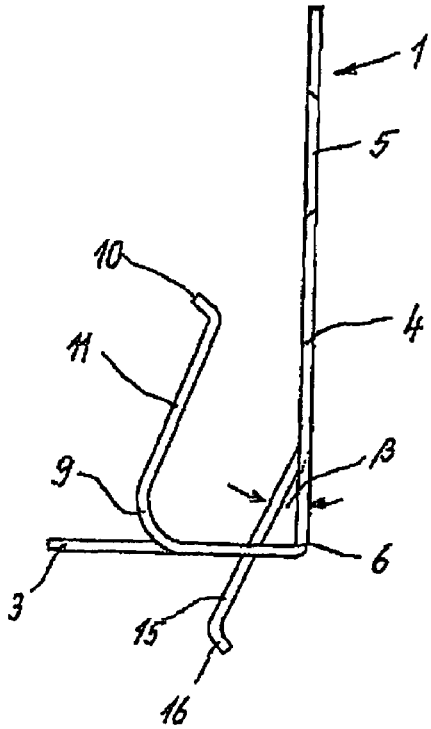
FIG. 4 shows a side view of the same device.

FIG. 4 illustrates a side view of this device 1. It should be mentioned in particular that it is not just the case that the downwardly bent tongue 15 is cut out of the central part 14 of the floor leg 3; rather, the cutout also extends someway upward into the wall leg 4 from the angle corner 6. The tongue 15 here is angled in a fully rectilinear manner, without any curvature, and is located at an angle β of approximately 30° in relation to the wall 20. As soon as the tongue 15 engages in the gap 19 in the floor, it will press the angle profile 2 to a greater or lesser extent, depending on the gap width, onto the wall 20.

Figure 5:
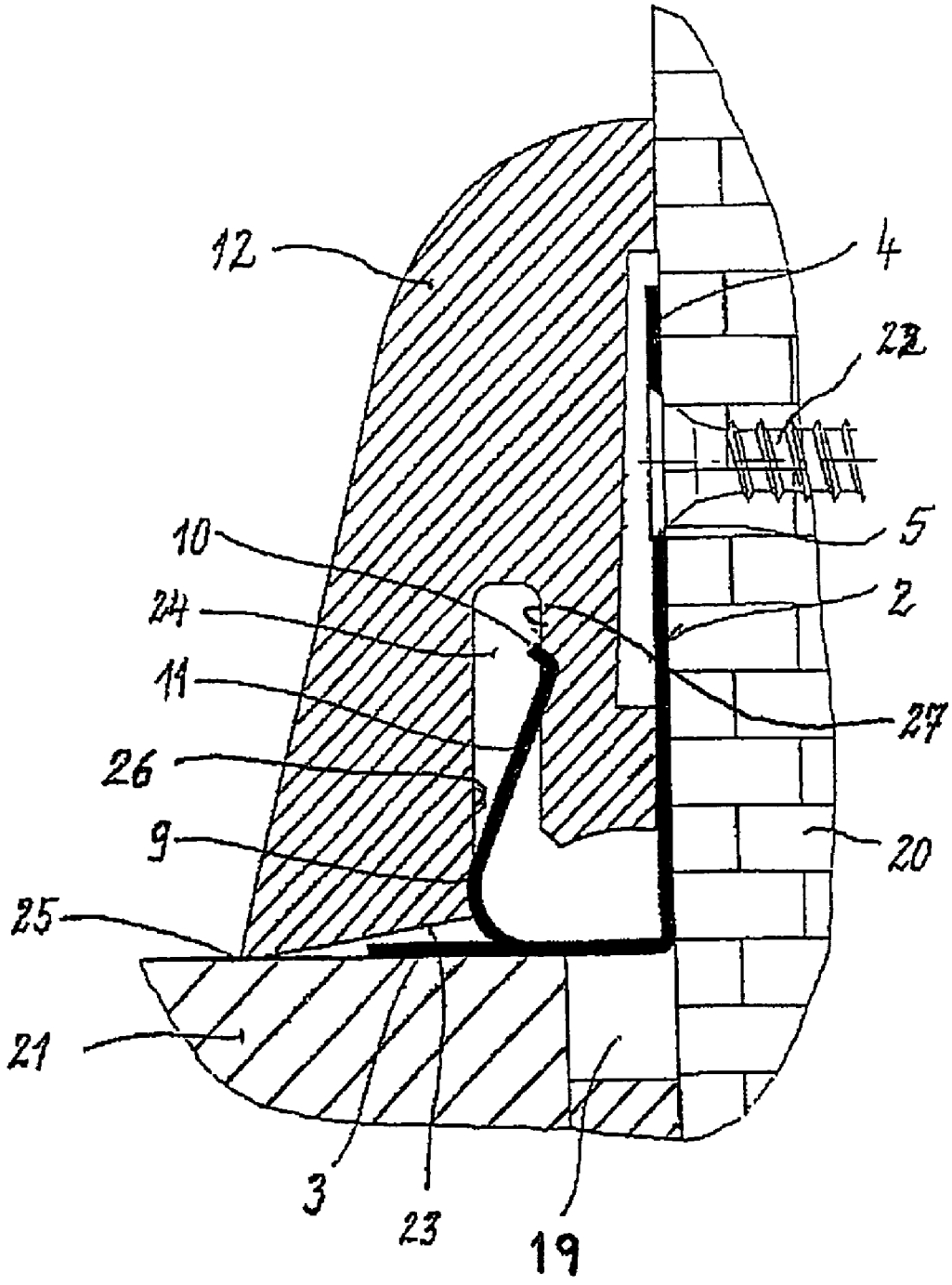
FIG. 5 shows a device which is secured on the wall and has a termination strip attached to it.

FIG. 5 shows both the wall 20 and the floor covering 21, between which a gap 19 remains when the floor is laid, the intention being for this gap to be covered by the termination strip 12. For this purpose, the device 1 is secured, as angle profile 2, on the wall 20 by means of a screw 22 engaging through the hole 5. The angle profile 2 is positioned on the wall 20 such that it rests on the floor covering 21 by way of its floor leg 3. Consequently, no auxiliary means is required for installation purposes. The receiving finger 11 is bent upward via a curve 9 and is directed toward the wall 20 by the angle α. The termination strip 12 is attached to the receiving finger 11 and engages over the receiving finger 11 by way of its groove 24 made in the base 23. The further the receiving finger 11 engages in the groove 24, the more its bent end 10 presses the termination strip 12 against the wall 20. In particular if the curve 9 at the bottom penetrates into the groove 24, the bottom part of the termination strip 12 is forced away from the wall 20 to a slight extent, and its top part is pressed toward the wall 20.

It can clearly be seen from FIG. 5 that the curve 9 and the free end 10 of the receiving finger 11 have an increased level of spring stressing, by means of which they press the termination strip 12 against the wall 20. It is the case both that the curve 9 has to become narrower as the groove 24 engages over it and that the receiving finger 11 has to assume more acute positioning in relation to the wall 20 by way of its free end 10, as a result of which the resilient pressing force is increased and the desired contact-pressure force is achieved. The curve 9 presses onto the outwardly directed wall 26 of the longitudinal groove 24, and the free end 10 of the receiving finger 11 presses against the inwardly directed wall 27 of the longitudinal groove 24, so that the termination strip 12 is always positioned flush against the wall. Even if the floor 21 should settle, the termination strip 12 can simply be pushed to a lower level until the bottom, front edge 25 of the termination strip 12 rests on the floor covering 21 and the groove 24 is covered.

LIST OF DESIGNATIONS

1 Device
2 Angle profile
3 Floor leg
4 Wall leg
5 Fastening hole
6 Angle corner
7 Incision
8 Crosspiece
9 Curve
10 Free end
11 Receiving finger
12 Termination strip
13 Underside
14 Central part
15 Tongue
16 Bent end
17 Hole
18 Tongue cut
19 Gap
20 Wall
21 Floor covering
22 Screw
23 Base
24 Groove
25 Edge
26 Outwardly directed wall
27 Inwardly directed wall

The invention claimed is:

1. A construction set comprising:
a termination strip; and
a device for fastening the termination strip, said device comprising:
an installation profile for the termination strip, said profile being formed by an angle profile which butts against a wall or floor and, as a fastening part, has a receiving finger on which the termination strip, which can be plugged thereon, is retained with a clamping fit, said angle profile having a wall leg and a floor leg,
wherein the receiving finger is a crosspiece which is disengaged from the floor leg of the angle profile and is bent upward via a curve and approaches the wall leg of the angle profile rectilinearly and at an acute angle (α) and engages in a longitudinal groove in the termination strip from beneath the termination strip, and
wherein the curve of the crosspiece presses against an outwardly directed bottom wall of the longitudinal groove and a top end piece of the receiving finger presses against an inwardly directed wall of the longitudinal groove.

2. The construction set as claimed in claim 1, wherein the receiving finger is disengaged by at least one cut which runs into the floor leg of the angle profile perpendicularly to an angle corner.

3. The construction set as claimed in claim 1, wherein the curve of the crosspiece covers more than 90°, and the acute angle (α) of the crosspiece in relation to the wall leg is 5° to 30 °.

4. The construction set as claimed in claim 1, wherein a free end of the receiving finger is bent or rounded in a direction counter to the curve.

5. The construction set as claimed in claim 1, wherein there are a plurality of receiving fingers branched off from the floor leg of the angle profile at a distance apart from one another.

6. The construction set as claimed in claim 1, wherein the receiving finger is a resilient strip made of metal or plastic which is engaged in the longitudinal groove, said longitudinal groove being made in the termination strip vertically from beneath and being at least three times as thick as the receiving finger.

7. The construction set as claimed in claim 1, wherein a height of the receiving finger is shorter than a depth of the longitudinal groove.

8. The construction set as claimed in claim 1, further comprising a downwardly-angled tongue projecting out of the floor leg of the angle profile.

* * * * *